United States Patent [19]

Salomon

[11] Patent Number: 4,487,427

[45] Date of Patent: Dec. 11, 1984

[54] SYSTEM FOR BINDING A BOOT TO A SKI

[75] Inventor: Georges P. J. Salomon, Annecy, France

[73] Assignee: S.A. Etablissements Francois Salomon & Fils, Annecy, France

[21] Appl. No.: 300,787

[22] Filed: Sep. 10, 1981

[30] Foreign Application Priority Data

Dec. 11, 1978 [FR] France ..... 7835488
Mar. 3, 1979 [FR] France ..... 7907071

Related U.S. Application Data

[63] Continuation of Ser. No. 63,556, Aug. 3, 1979, abandoned.

[51] Int. Cl.[3] ..... A63C 9/20

[52] U.S. Cl. ..... 280/615; 36/117; 280/636

[58] Field of Search ..... 280/615, 614, 636, 607, 280/623, 611; 36/117

[56] References Cited

U.S. PATENT DOCUMENTS

| | | | |
|---|---|---|---|
| 2,247,237 | 6/1941 | Johnson | 280/615 |
| 3,775,866 | 12/1973 | Mark et al. | 280/615 |
| 4,082,312 | 4/1978 | Johnson | 280/615 |
| 4,129,319 | 12/1978 | Strohmorer | 280/615 |
| 4,186,500 | 2/1980 | Salzman | 36/117 |
| 4,235,452 | 11/1980 | Linecker | 280/615 |
| 4,312,141 | 1/1982 | Mayer et al. | 280/615 |

FOREIGN PATENT DOCUMENTS

| | | | |
|---|---|---|---|
| 179511 | 1/1954 | Austria | 280/615 |
| 2815167 | 10/1978 | Fed. Rep. of Germany | 280/615 |
| 2338719 | 8/1977 | France | 280/615 |
| 2382248 | 9/1978 | France | 280/614 |

*Primary Examiner*—David M. Mitchell
*Attorney, Agent, or Firm*—Pollock, Vande Sande & Priddy

[57] ABSTRACT

A system for binding a boot to a ski in such manner as to permit the heel of the boot to be lifted from the top surface of the ski. The system includes complementary members for laterally retaining the boot on the ski, these members extending substantially longitudinally with respect to the boot, at least beneath the front thereof. One of the members is located beneath the boot and the other on the top surface of the ski, and the members have complementary shapes so as to assure their cooperation during all phases of movement of the skier's foot.

3 Claims, 22 Drawing Figures

FIG. 7
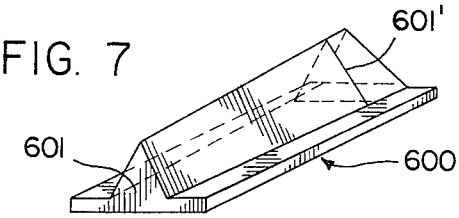
FIG. 8
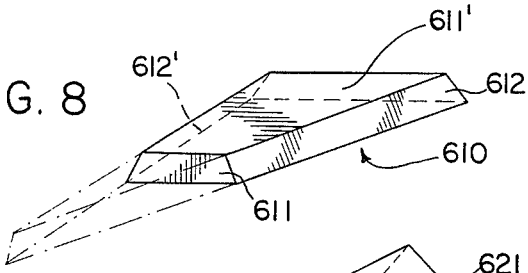
FIG. 9
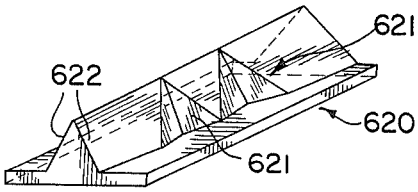
FIG. 10
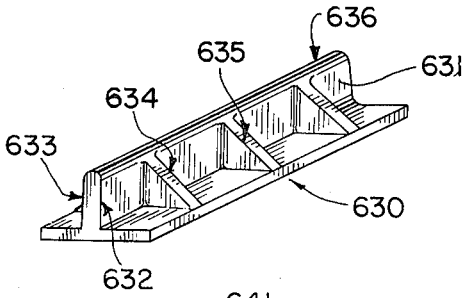
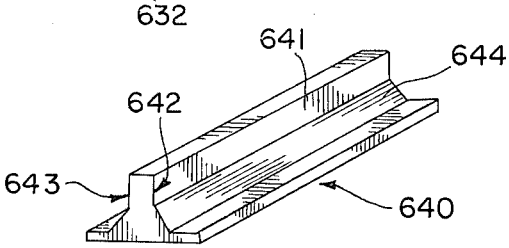
FIG. 11

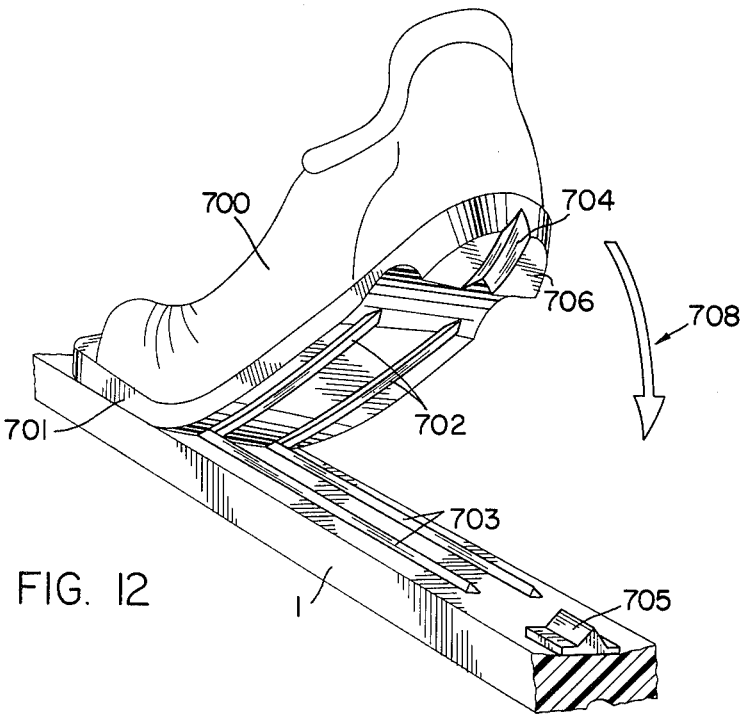
FIG. 12
FIG. 13
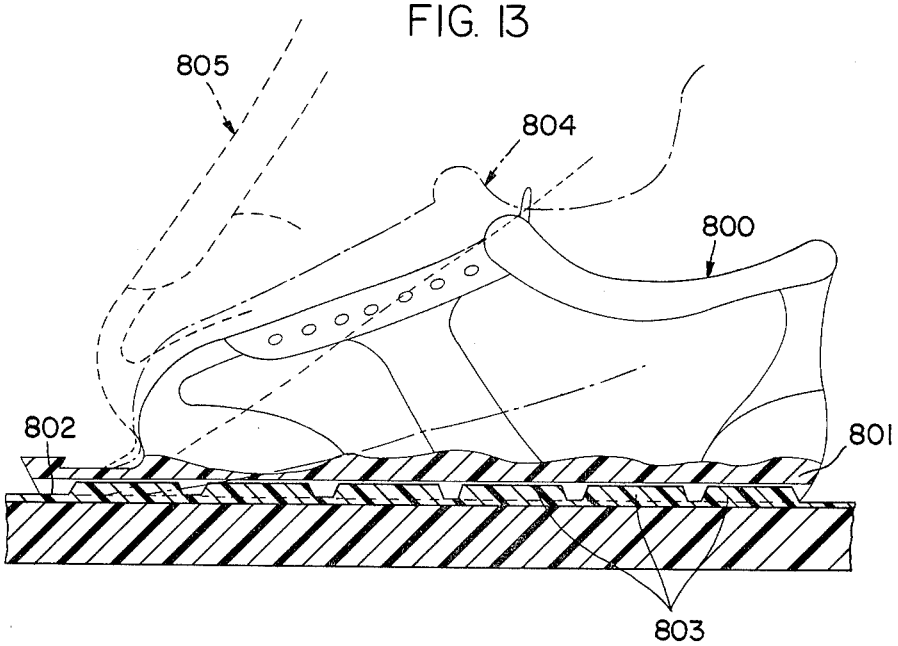

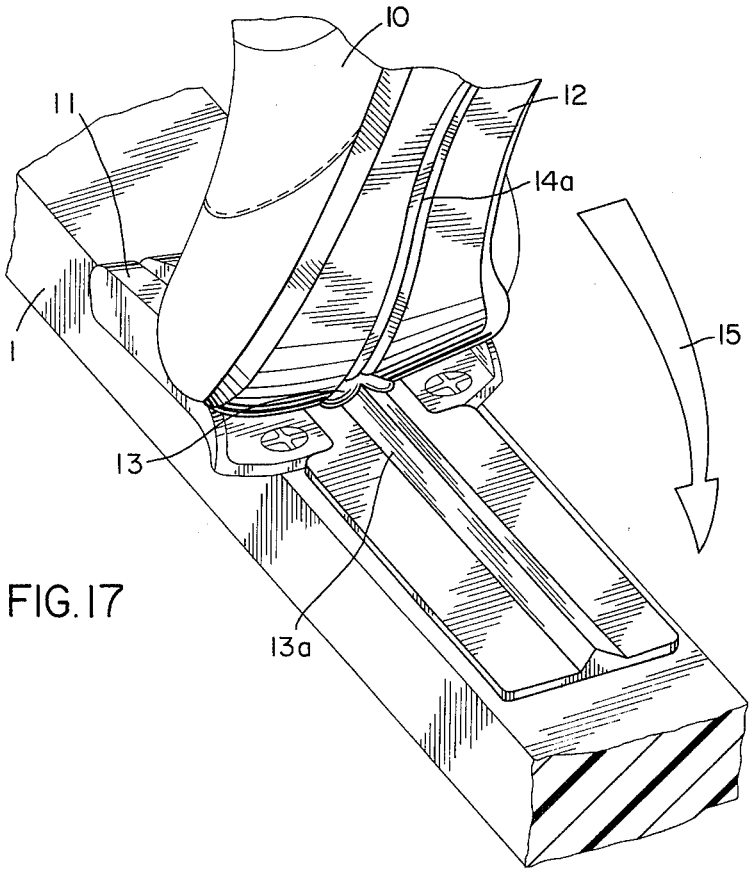
FIG. 17
FIG. 18
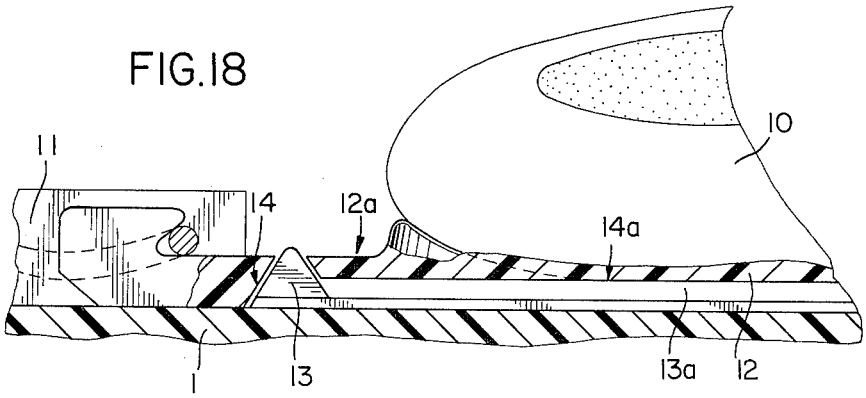

SYSTEM FOR BINDING A BOOT TO A SKI

This is a continuation of application Ser. No. 063,556, filed Aug. 3, 1979, now abandoned..

BACKGROUND OF THE INVENTION

The present invention relates to a system for binding a boot to a ski, intended for the practice of cross-country skiing.

Present-day ski boots for practicing cross-country skiing are being more and often more designed with means for laterally guiding and retaining the heel, which must allow a movememt of the foot which remains as much as possible in the longitudinal axis of the ski, thus ensuring better guidance of the ski itself. To this end, several types of construction for retaining the heel have been proposed.

One such construction consists of a longitudinal centering V recessed under the heel of the boot, in which a corresponding projecting V-section located on the ski is housed. The major drawback of this solution resides in the fact that centering of the boot on the ski is effected only in the final phase of the movement of the foot when it rests on the ski. Thus, this type of centering, which occurs only during the last ten millimeters of the movement, does not prevent the possibly off-centered and offset movements of the foot, particularly on hills. Moreover the desired centering may not take place at all due to torsional or other deformations, of the sole, as a result of which the V-notch may fail to engage the corresponding projecting section of the ski. At best, the skier is obliged to center his heel on the V of the ski himself. This voluntary attempt at centering then risks losses of balance, of speed, and therefore of time, which is prejudicial particularly in the case of competition.

Other types of construction employ hard tips, disposed in triangles and set up on the top surface of the ski and penetrating a zone of softer material located beneath the heel opposite said tips, when the foot reaches the final phase of its movement and when it rests on the ski. In this case, the same drawbacks are found as mentioned hereinabove, in addition to that of not having any centering at all, as the tips are planted in the soft part of the heel without being able to determine the path of movement of the boot as it comes to rest on the ski.

Finally, there is a device for guiding the boot on the ski, which acts during all the phases of movement of the foot. However, this device requires the assembly of a guide element which extends vertically with respect to the ski and of which the height is at least as great as the height of the lift of the foot when it moves. This device, which functions in principle, has the drawback of being unaesthetic on the one hand and relatively voluminous on the other hand. Moreover, it requires a guide device which is virtually as voluminous, adaptable to the boot itself and awkward for the user not only due to the weight of the assembly, but also due to its bulk, especially as far as the part adaptable to the boot is concerned, which prevents easy walking without the skis.

SUMMARY OF THE INVENTION

The purpose of the present invention is to remedy the drawbacks of the various prior art devices by providing a ski boot for the practice of cross-country skiing, of which the centering of the sole is advantageously effected during all the phases of movement of the foot, with respect to the longitudinal axis of the ski and its upper surface. According to another advantageous feature of the invention, this purpose is attained by the use of means of reduced dimensions and weight, of which the functioning remains reliable under all the conditions of use. To this end, a system for binding a boot to a ski comprising, according to known means, located at the front of the boot, a connection allowing the lift of the heel of said boot from the top surface of the ski, is characterized in that means for laterally holding the boot on the ski extend substantially longitudinally with respect to said boot, at least in the zone located beneath the front thereof, and one part of said lateral holding means is located beneath the boot and the other part on the top surface of the ski, the two parts comprising sections of complementary shape, ensuring their cooperation during all the phases of movement of the foot during the practice of skiing.

According to a first embodiment of the invention, a cross-country ski boot has a sole made of supple but abrasion-resistant material, preferably comprising, in the front zone thereof, at least one groove extending substantially longitudinally from the tip of the boot at least up to the metatarsal zone, where the zone of flexion of the sole is located. The boot thus made cooperates with a projecting shaped part corresponding to the groove, located on the surface of the ski so that, when the boot is connected to the ski by its binding, said groove and said projecting part cooperate by engagement of the projecting part in the groove. This cooperation is effected not only when the sole of the shoe rests totally on the ski, but also when, during cross-country walking movement, the foot lifts forwardly and only a small portion of cooperation remains between the groove and the projecting part. Then, when the foot returns to its flat position on the ski during the final phase of its movement, the cooperating parts progressively make contact on all their surfaces and thus ensure lateral retention of the boot on the ski, by this substantially longitudinal guidance. In this embodiment of the invention, the cooperating parts are composed of sections of complementary shape, enbling the projecting part to be fixed longitudinally on the ski without the need for excessively complicated positioning adjustments with respect to existing bindings already mounted on the ski.

According to a further embodiment of the invention, the sole of the boot comprises a substantially longitudinal recessed part, advantageously extending over the whole length of the sole and cooperating with a corresponding projecting part located on the ski. This type of construction permits a constant guidance of the sole during all the phases of movement of the foot, ensuring therefore a lateral retention with respect to the ski. Moreover, the arrangement of the recessed part beneath the whole length of the sole presents the advantage of allowing guidance of the boot facilitating its introduction in the binding. As in the first embodiment, the cooperating parts are composed of sections of constant cross section. Nevertheless, the cooperating parts may comprise, without departing from the scope of the invention, sections of variable cross section, so that, as the foot moves towards its final position (i.e., of rest upon the ski), the surfaces of the cooperating parts which are in contact are increased to a maximum in order to give most effective guidance to the ski for its trail in the snow. Of course, the cross sections of the respective sections may have a variety of shapes without departing from the scope of the invention. Similarly, it is possible to provide the cooperating parts with notches for clearing the snow, disposed laterally on each side of said parts, in order to preserve effective guidance of the sole and of the ski, by ensuring that said parts are free of snow or ice. Although these notches may be arranged independently on the sole or on the projecting part disposed on the ski, it will be advantageous to provide them on both elements. Finally, it is possible to improve the guidance and lateral retention of the boot on the ski by making a section whose cross section advantageously comprises two sides vertical with respect to the plane of the ski, in addition to so-called centering or guiding sides. Cooperating parts are thus obtained which procure an appreciable movement of the lateral retention means according to the invention. As a function of the modes of construction, the retention zone (with its vertical sides) is independently located either on or under the guiding zone of the projecting part located on the ski, for example. According to a particular mode of construction of the cooperating parts combining the guiding and retention zones, a projecting part, located on the ski, comprises a vertical edge on each side of which ribs extend perpendicularly, connecting the top of said edge with the upper surface of the ski by a sloping generatrix. This mode of construction assures both guidance and lateral retention for a minimum height. It should be noted that it is advantageously possible to provide ski boots with a plurality of these lateral retention means, disposed parallel to one another, for example between said skis and boots.

According to a further embodiment of the invention, the cooperating parts of the lateral retention means on boot and ski have sections of variable cross section but of constant height. These sections have, for example, a volume of constant thickness the bases of which are similar triangles, the largest base resting on the top surface of the ski, the height of the triangles being merged with the longitudinal axis of the boot on the ski. With this type of construction, progressive guidance and lateral retention are obtained, for a reduced height of the projecting section acting as a wedge in the sole of the boot, and in addition acting in the manner of herring-bone tread designs (e.g on the tractor tires), during the phase of movement of the foot when the latter is in passive extension necessary for holding the leg rearwards preparing for the sequence of the following step. It is obvious that this mode of construction may be applied beneath the whole length of the sole similarly to one of the cases previously described, with a view to obtaining the same advantages. As a general rule, it is understood that the man skilled in the art may combine one or more of the modes of construction described, so that, without departing from the scope of the invention, he may produce the construction which he considers most suitable from the point of view of performance and/or ease of use. Thus, it is not imperative that the projecting part located on the ski, for example, is made in one piece, a plurality of portions of projecting parts may be arranged coaxially in line with one another, leaving intervening gaps. Finally, the lateral retention means may be provided between boot and ski where the projecting part is disposed on the sole and the recessed part on the ski.

According to a further embodiment of the invention, lateral retention means are further provided located essentially in the zone of the tip of the sole of the cross-country boot. When, during the cross-country walking movement, the foot moves forward and only a small surface of support remains between the sole and the top surface of the ski, localized by a zone of contact from the binding means to the toe support zone, the lateral retention of the foot is then minimal. This lack of lateral retention in this position of the foot is particularly prejudicial for the immediately succeeding phase when the foot returns onto the ski. It is therefore important for the foot to be directly guided with maximum efficiency for its return, flat on the ski, to be effected along the longitudinal axis of the ski.

To this end, the system for binding a boot to a cross-country ski further comprises lateral retention means extending substantially longitudinally with respect to said boot essentially in a zone of contact of the sole from the means for binding the boot to the ski up to the support zone, said lateral retention means comprising intercooperating parts composed of sections of complementary shape the volume of which decreases from the front to the rear of the boot.

BRIEF DESCRIPTION OF THE DRAWINGS

The invention will be more readily understood on reading the following description with reference to the accompanying drawings, in which:

FIGS. 4 to 11 are perspective views of different types of projecting cooperating parts of the lateral retention means which may be arranged on the top surface of the ski.

FIG. 12 is a perspective view of a binding system, showing the boot about to be placed on the ski, and which advantageously comprises a particular arrangement of a plurality of complete means for laterally retaining the sole.

FIG. 13 is a view in partial longitudinal section of another variant of a system for binding a boot to a ski.

FIG. 17 is a view in perspective of a binding assembly according to the invention applied to a presently existing cross-country boot.

FIG. 18 is a view in partial longitudinal section of the front of the boot shown in FIG. 17, showing a possible variant of the binding system according to the invention on a presently existing cross-country boot.

DESCRIPTION OF THE PREFERRED EMBODIMENTS

Figure 1:
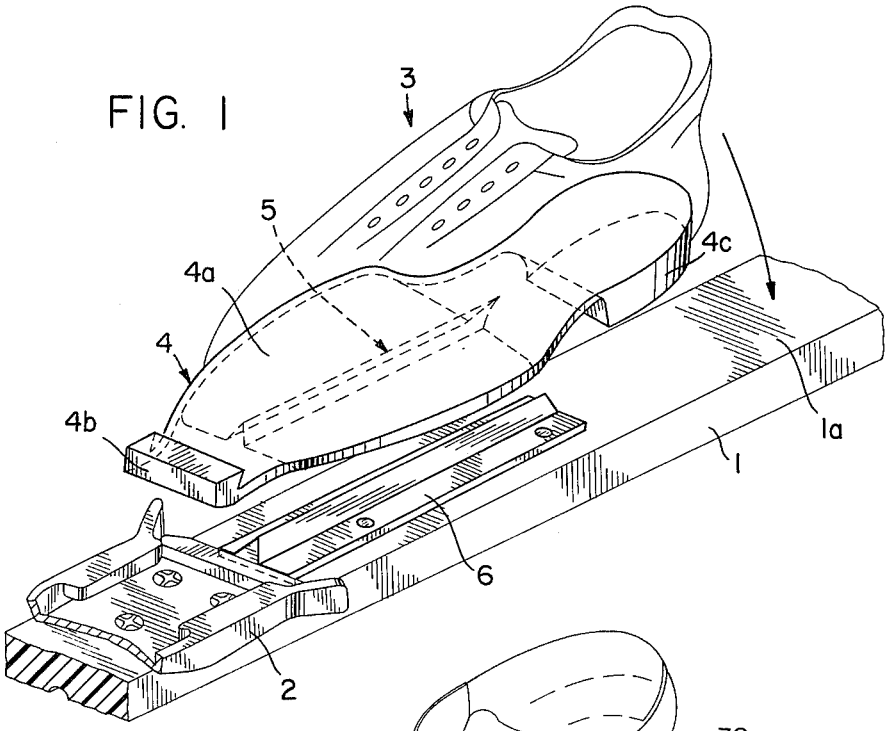
FIG. 1 is a perspective view of a binding system according to the invention in which a boot sole (shown in dark lines) comprises one part of the lateral retention means disposed in the front zone, and in which the complementary part of said means is disposed on the ski.

Referring now to the drawings, FIG. 1 shows a system binding a cross-country boot 3 to a ski 1 via a binding 2 of known type. The particularity of the assembly thus composed resides in the fact that the sole 4 of the cross-country boot 3 advantageously comprises in its front part 4*a*,located beneath the front zone of the skier's foot, a longitudinal groove 5 the cross-section of which is, for example, triangular. This groove 5 cooperates with a projecting longitudinal part 6 of triangular cross section disposed on the ski in the zone corresponding to the front-foot support zone, so that, when the skier's foot moves, the two recessed and projecting parts mate with each other. The cooperation between the ski and the boot made via said recessed and projecting parts then ensures permanent guidance and lateral retention of the boot on the ski during all phases of movement of the foot. In fact, the cooperating parts 5 and 6 act, according to the arrangement of the invention, from the front zone of the sole of the boot when the foot is in position of passive extension (when the foot is essentially supported on the toes) to at least the zone of the sole corresponding to the metatarsal and tarsal supports of the foot when it is placed on the ski. This zone of greater width of the foot being progressively and continuously guided by the centering (V-shaped in FIG. 1), of the lateral retention means, the risks of the plantar arch getting out of true due to hilly course or ground are reduced, and thus slipping of the heel 4*c* with respect to the top surface 1*a* of the ski is avoided.

Figure 2:
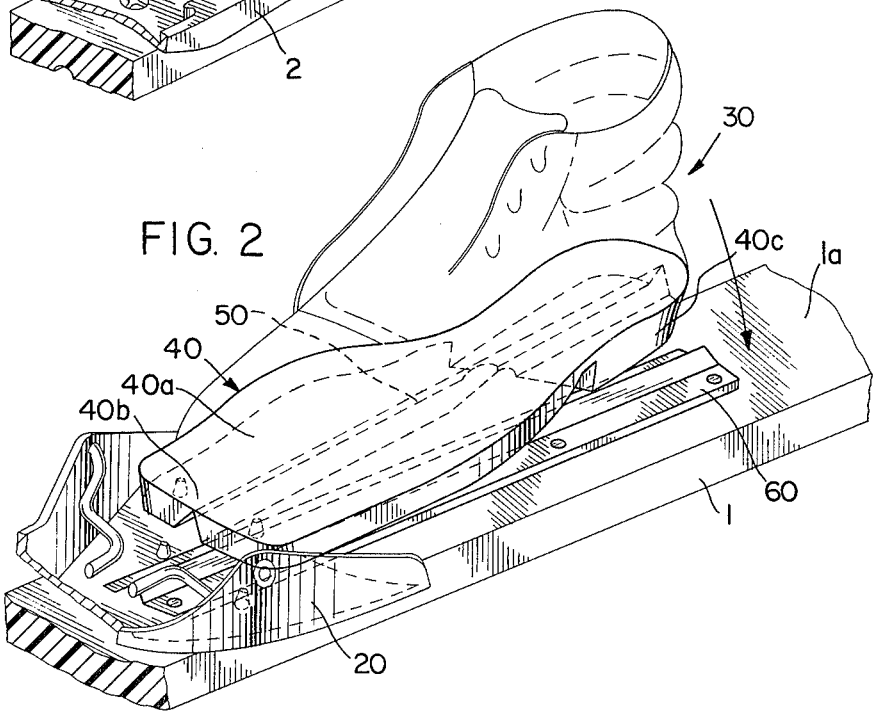
FIG. 2 is a perspective view of another binding system according to the invention in which the boot sole comprises one part of the lateral retention means disposed under the whole length of the sole, and in which the complementary part of said means is disposed on the ski.

In the second embodiment shown in FIG. 2, a cross-country boot 30 is provided with another type of binding 20, to illustrate that the assembly according to the invention may be used with all types of cross-country ski boots. In this case, the lateral retention means composed of recessed part 50 under the sole 40 and projecting part 60 cooperating therewith, extend without interruption beneath the whole length of the sole 40, from the zone of the tip 40*b* cooperating with the binding 20 of known type to the zone of the heel 40*c*. Consequently, not only is guidance of the boot advantageously effected during all phases of movement of the foot, but this arrangement further provides for the skier a guidance of his boot 30 as soon as it is fitted in its binding 20. It will be generally noted that the cooperating parts of complementary form have, in the embodiments described, sections of triangular form which are constant over the whole of their length. These forms of constant section may, however, be varied as shown in FIGS. 4, 5, 6 and 11 where other shapes for the cooperating projecting parts are shown, provided that the recessed shape beneath the sole of the boot has a complementary configuration.

The two embodiments described with reference to FIGS. 1 and 2 may also be provided with cooperating projecting parts, intended to be fixed to the ski, the sections of which vary over the length of said parts, as shown in FIGS. 7 and 8. The cooperating parts 600, 610 shown respectively comprise sections 601, 611 which diverge towards surfaces 601' and 611', located at the rear ends of parts 600 and 610. This variation in section advantageously enables the lateral retention of the boot to be increased as it rests on the ski due to the increase in the surface of fit of the two complementary cooperating parts.

Figure 6:
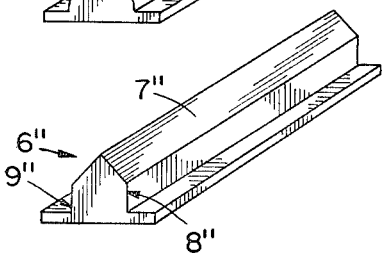

Finally, FIG. 9 shows a possibility of improving the penetration of the projecting part 620 in a corresponding V-groove in the sole of a boot according to the invention. In this variant notches 621 are cut on the converging walls 622, widening towards the base of said parts 620, thus enabling snow or ice lodged in the groove of the sole to be evacuated when the projecting part penetrates in the recessed part. It goes without saying that this notched configuration is applicable to the other types of projecting parts. Similarly, it is possible to arrange such notches perpendicularly to the recessed part of the sole. It is also possible, in the embodiments shown in FIGS. 1 and 2, advantageously to use the lateral retention means of which the cooperating parts present a zone perpendicular to the plane of the ski in the form of their sections (FIGS. 6, 10, 11). In this construction, the two main functions of the lateral retention means are advantageously combined, namely, guidance or centering in the first, penetration stage of the projecting cooperating part (6'', 630, 640) in the corresponding recessed cooperating part, then, in the second stage, lateral retention of the recessed part fitted on the projecting part. In the case of FIG. 6, for example, the upper triangular portion 7'' of the projecting cooperating part 6'' serves as wedge for introduction in the complementary recessed cooperating part located beneath the sole. Then as the sole moves onto the ski, the vertical walls 8'', and 9'' of the cooperating part located beneath the upper triangular part 7'' are housed in the corresponding recessed parallelepipedic portion of the sole. The cooperating projecting part 640 shown in FIG. 11 acts similarly to the previously described case, except that an upper parallelepipedic portion 641 forming ridge is located above a lower triangular guiding portion 644. In this case, th ridge 641 firstly comes into contact with the sloping walls of the triangular guide section located at the inlet of the groove of the sole, ensuring guidance of the sole, and then, the movement of the sole continuing onto the ski, the vertical and lateral walls 642 and 643 of ridge 641 are housed in the recessed zone of rectangular section of the sole.

In the case of FIG. 10, an advantageous arrangement of the projecting cooperating part 630 has been developed so that the vertical walled portions for the lateral retention function and the triangular (or substantially triangular) section portions for the guidance function are combined to a given height. To this end, protection part 630 is composed of a central web 631 perpendicular to the ski, for example of constant height. Perpendicularly to the central web 631 and its vertical walls 632 and 633, ribs 634 extend transversely from the top 636 of said ridge towards the base of the part 630 along a generatrix 635. The advantage of this type of construction resides in the fact that not only are the functions of guidance and of lateral retention performed respectively by the central web 631 and the transverse ribs 634, but, these same ribs also ensure a support stop for starting the stride when the corresponding complementary part of the sole fits on part 630.

Figure 3:
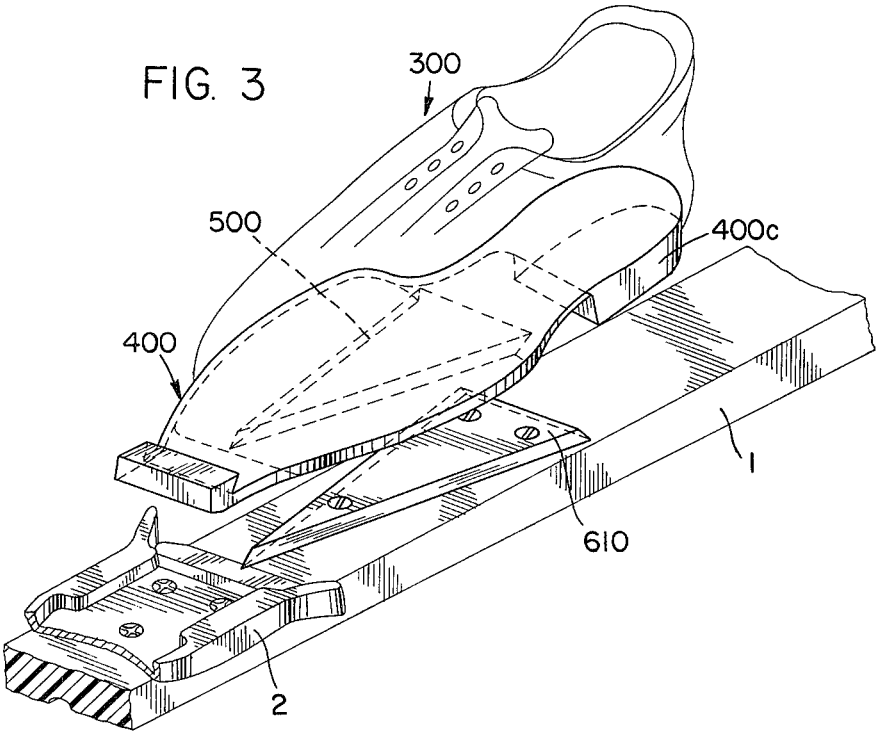
FIG. 3 is a perspective view of another system for binding a boot on a ski in which the boot sole comprises one part of the lateral retention means disposed in the front zone having a section of constant height, but of variable section, and in which the complementary part of said means is disposed on the ski.
Figure 4:
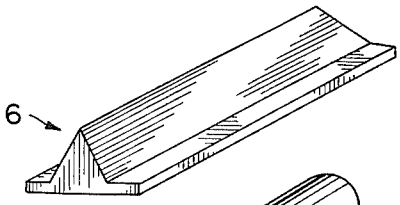
Figure 5:
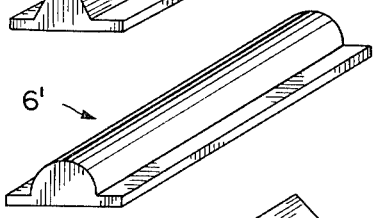

FIG. 3 shows a particular type of embodiment of a system for binding a cross-country boot 300 to a ski 1, comprising a binding 2 of known type and retention means comprising, according to the invention, a recessed cooperating part 500 in the front zone of the sole 400 and a complementary projecting cooperating part 610 fixed in corresponding manner on the ski.

As in the cases described above, the axis of the retention means is disposed in the longitudinal direction of the boot. In this embodiment, the projecting cooperating part 610 forms a solid, the volume of which is limited by a large triangular base adjacent the ski and a smaller comgruent surface spaced therefrom and preferably parallel thereto. The two bases are then joined together as illustrated in FIG. 8, which shows a transverse section through a portion of the projecting part 610 by lateral inclined walls 612, 612', the transverse section of solid 610 varying along surfaces diverging towards the rear from 611 to 611' for example. In complementary manner, the same volume is arranged in the sole, producing the recessed cooperating part 500. The advantage of this type of construction is that, despite reduced height of the projecting part, progressive guidance and centering are obtained, and lateral retention increases as the foot returns onto the ski. Moreover, as has already been set forth, a support stop is obtained for starting the succeeding step proportional to the extent of surface of the cooperating parts 500, 610 in contact with each other when the foot is moving. It is possible, without departing from the scope of the invention, to extend these cooperating parts from the zone of the flexible bar entering into the binding 2 to the zone of the heel 400*c*, for example.

FIGS. 12 and 13 show possible combinations of structures for the binding system according to the invention. The binding system shown in FIG. 12 comprises, in the front zone of the sole 701, two lateral retention means, disposed parallel to each other, while in the zone of the heel, there is located a centering V known per se, larger than the first two lateral retention means mentioned. The boot 700 is shown in its phase returning flat onto ski 1, as indicated by arrow 708. The lateral retention means located in the front zone of the sole 701 are constituted by two longitudinal V-sectioned grooves 702 in the sole cooperating with two V-sectioned projecting parts 703 disposed parallel to each other. It will be noted that, during the whole phase of the boot returning flat onto the ski, the boot is already guided and centered in its front part and is fully centered at the moment when the heel 706, likewise provided with a groove 704, enters into contact with the V-sectioned projecting part 705 fixed to the ski.

The binding assembly shown in FIG. 13 comprises a longitudinal groove 802 of any section and shape, disposed beneath the entire length of the sole 801 of the boot and with which a plurality of projecting cooperating parts 803 fast with the ski cooperate. These projecting parts 803 form a discontinuous longitudinal series of contact surfaces, which is advantageous from the point of view of weight reduction. Despite this discontinuity, guidance and centering of the sole 801 always remain ensured, as shown by the various positions 804 (in dashed and dotted lines) and 805 (in broken lines) of the boot when the foot is moving.

Figure 14:
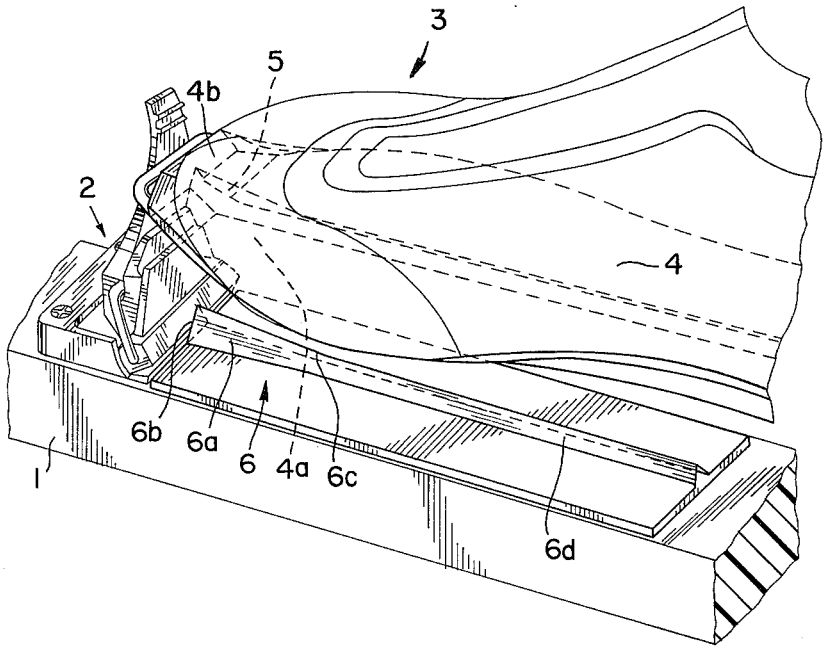
FIG. 14 is a view in perspective of another variant of a binding system according to the invention.
Figure 15:
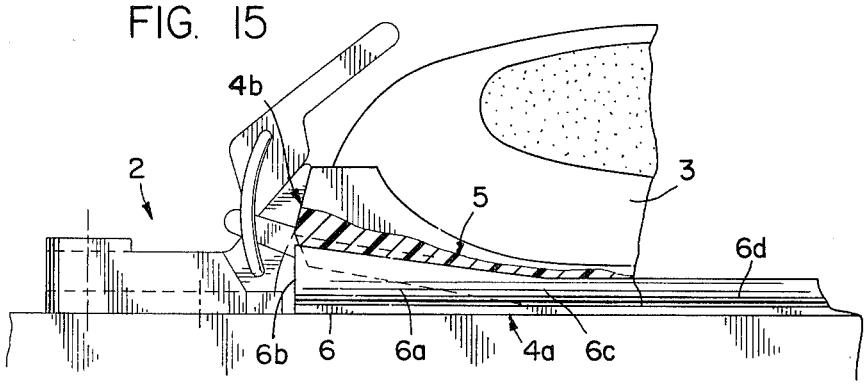
FIG. 15 is a view in partial longitudinal section of the front of the boot fixed on the ski in position of use, flat, by the binding system of FIG. 14.
Figure 16:
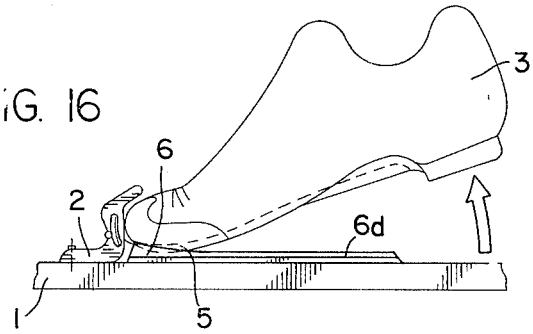
FIG. 16 is a schematic view in elevation of the binding system of FIG. 14 showing the permanence of cooperation of the boot with the ski due to the lateral retention means located in said front end zone of the sole.
Figure 19:
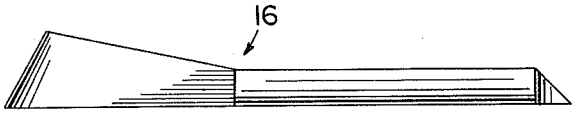
FIGS. 19 and 20 are views in elevation and in plan, respectively, of a variant of the retention means of a binding system according to the invention.
Figure 20:
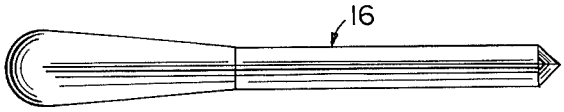

FIGS. 14 to 16 show a system for binding a cross-country boot 3 on a ski 1 via a binding 2 of known type. The particularity of the system thus formed resides in the fact that the sole 4 of the cross-country boot 3 advantageously comprises in its front end part 4*a* a longitudinal groove 5 extending from the end 4*a* of the sole up to at least the zone of support of said sole corresponding to the toes.

This groove 5 extends beneath the entire length of the sole. It is of triangular section and cooperates, when the boot 3 is fixed on the ski 1, with a projecting part 6 of complementary shape to said groove, fixed on the ski in the zone corresponding to the zone of contact 4*a* of the sole from the binding to the toe support zone. The projecting part 6 is therefore immediately adjacent the binding 2 so that, when the skier's foot moves, the recessed part 5 and projecting part 6 composing the lateral holding means mate with each other. In fact, even when the foot is in a position of passive extension, i.e., when the foot is essentially supported on the toes, the cooperation between the end of sole and the ski remains ensured, due to the fact that the parts 5 and 6 are located in this toe support zone. Due to the invention, this cooperation is enhanced as the section of these parts is constituted in its front part, concerning the projecting section 6, by a portion of a frustrum of a cone or pyramid 6*a* of which the large base 6*b* (of triangular section in the example shown) is located on the binding 2 side and the small base 6*c* towards the rear of the boot. Consequently, and precisely during the phase of passive extension of the foot, shown in FIG. 16, at the moment when the sole is in position of minimum contact with the ski, guidance and lateral retention of this sole are maintained from the beginning of the phase of return of the foot flat onto the ski. The front part 6*a*, the cross section of which decreases towards the rear of the projecting section 6, may be extended rearwardly by a prismatic or cylindrical section 6*d*, therefore of constant height.

FIG. 15 clearly shows that the front end zone 4*a* of the sole 4 is centered on the ski with a maximum efficiency determined by the fact that the sections of the cooperating parts 5 and 6 comprise volumes of cross section decreasing from front to rear, making it possible to obtain maximum guidance and centering for a minimum contact surface of the sole on the ski.

FIGS. 17 and 18 show the adaptation of the binding system according to the invention to a cross-country boot and binding presently on the market.

A cross-country ski boot 10 having a sole 12 of the type standard 35, standard "Lin", standard 50, etc., is mounted on a ski 1 and fixed thereto by a binding 11 of type corresponding to the standard of the sole end 12*a*. The assembly thus made comprises, similarly to the preceding example, lateral retention means located in the front end zone of the sole to guarantee maximum cooperation between recessed parts 14 and projecting parts 13, for a minimum contact surface of the sole 12 on the ski 1. On this occasion, a projecting part 13 of conical or pyramidal form is located on the longitudinal axis of the ski and cooperates with a recessed part 14 of corresponding conical or pyramidal form, advantageously located in the center of the width of the tongue constituting the end 12*a* of the sole 12. From these lateral holding means of conical or pyramidal form, longitudinal sections 13*a* and 14*a* of triangular cross section extend. These sections, which are also respectively recessed and projecting and of triangular cross section substantially less than that of the cones or pyramids 13, 14, ensure the continuity of the centering and guidance during the phase when the foot returns to flat position on the ski (indicated by arrow 15,) effected at the beginning thereof by the parts 13, 14 cooperating with each other. The recessed part 14 may advantageously be open so that any snow lodged therein may be removed.

In this case, the embodiment of the system according to the invention would not be limited to recessed and projecting parts of conical shape, but all shapes the volume of which decreases from front to rear, allowing a maximum of centering for the position of minimum contact of the sole on the ski, are within the scope of the invention.

FIGS. 19 to 22 show two possible variant embodiments of projecting sections 16 and 17 which are beneath the front end zone of the sole and cooperate with corresponding recessed sections made in the sole.

Figure 21:
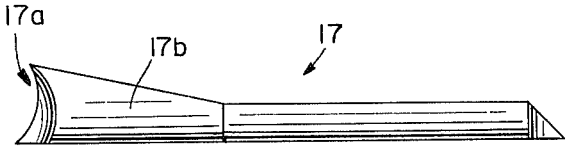
FIGS. 21 and 22 are views in elevation and plan respectively of another variant of the retention means.
Figure 22:
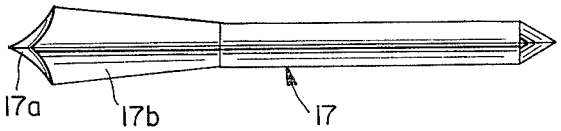

FIGS. 21 and 22 in particular, the front portion 17*b*, of rearwardly decreasing section, of the projecting section 17 advantageously comprises a stem 17*a* engaging in the groove of the corresponding sole when said latter is in its return phase to flat position on the ski.

It is obvious that the invention reaches its full effect only by the association of the lateral retention means in the front end zone of the sole with the lateral retention means extending beneath the metatarsal zone or even beneath the heel.

What is claimed is:

1. A system for binding a boot to a ski intended for the practice of cross-country skiing, comprising connecting means located at the forward end of the front of the boot pole only, assuring retention of the front of the boot on the ski and allowing the heel of said boot to lift with respect to the top surface of the ski, and means for laterally retaining the boot on the ski extending substantially longitudinally with respect to said boot, at least in the zone located beneath the front of the boot, a first part of said lateral retention means comprising at least one recess located under and forming a portion of the sole of said boot, while a second part of said lateral retention means comprises at least one projection mounted on the top surface of said ski, said first and second parts having complementary cross sections of substantially inverted V shape decreasing in size from front to rear, assuring their cooperation during skiing, and extending along a longitudinal axis parallel to that of said ski.

2. A binding system according to claim 1, wherein said means for laterally retaining said boot on said ski extend substantially longitudinally with respect to said boot from the zone located under the fore foot to the zone located under the heel.

3. A binding system according to claim 1, wherein said complementary sections are extended rearwardly by rectilinear sections of constant cross section.

* * * * *